US006475645B1

(12) United States Patent
Osman et al.

(10) Patent No.: US 6,475,645 B1
(45) Date of Patent: Nov. 5, 2002

(54) SURFACE TREATMENT OF STEEL

(75) Inventors: Paul Alexander Osman, Chelmsford; Haibo Yan, University Park; Jian Yu, University Park; Laurence Charles Archibald, University Park; Samuel James Harris, University Park, all of (GB)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/744,635

(22) PCT Filed: Jul. 26, 1999

(86) PCT No.: PCT/GB99/02409

§ 371 (c)(1),
(2), (4) Date: Apr. 2, 2001

(87) PCT Pub. No.: WO00/06808

PCT Pub. Date: Feb. 10, 2000

(30) Foreign Application Priority Data

Jul. 29, 1998 (GB) ..... 9816402

(51) Int. Cl.[7] ..... C25D 5/10; C25D 15/00; C23C 28/02

(52) U.S. Cl. ..... 428/659; 205/177; 205/184; 205/109

(58) Field of Search ..... 205/177, 184, 205/109; 428/659

(56) References Cited

U.S. PATENT DOCUMENTS 4,839,241 A * 6/1989 Abe et al. ..... 428/659
5,834,128 A * 11/1998 Hamahara et al. ..... 428/626

FOREIGN PATENT DOCUMENTS

| | | | |
|---|---|---|---|
| EP | 182964 A1 | * | 6/1986 |
| EP | 290836 A2 | * | 11/1988 |
| EP | 323756 A1 | * | 7/1989 |
| JP | 60-138093 A | * | 7/1985 |
| JP | 8-060399 A | * | 3/1996 |

OTHER PUBLICATIONS

References N–R were cited on the International Search Report.*

* cited by examiner

*Primary Examiner*—Edna Wong
(74) *Attorney, Agent, or Firm*—Damian Porcari

(57) ABSTRACT

A painted steel article having a steel surface, being plated with a corrosion-resistant coating. The corrosion-resistant coating contains at least 90% zinc, cobalt, at least one trivalent or higher-valent metal, and at least one colloidal inorganic material. The paint is then electrodeposited directly on the corrosion-resistant coating.

18 Claims, 4 Drawing Sheets

SURFACE TREATMENT OF STEEL

BACKGROUND OF THE INVENTION (1) Field of the Invention

The present invention relates to a steel article coated with a novel pre-treatment coating for receiving an organic coating such as paint, and to a process for applying such a pre-treatment surface coating to steel.

(2) Description of the Prior Art

Steel panels and other components are used extensively in the construction of motor vehicle bodies and other structures. The problem of corrosion of steel by environmental factors is well known, and much work has been carried out to provide steel with coatings to reduce corrosion. Zinc coatings are widely used in the protection of steel strip against corrosion. In the automobile industry the introduction of zinc coatings in conjunction with phosphate and/or chromate treatment processes and multiple paint layers has provided six or more years of protection. The phosphate or chromate treatment is necessary to ensure that the zinc-coated surface is sufficiently corrosion resistant and can be electrocoated with a sufficiently coherent paint layer.

In addition to the barrier protection provided by these coatings the zinc can act in a sacrificial manner to prevent rust formation if the steel is exposed by scratching or stone-chipping to the atmosphere. The zinc-coated steel is also capable of being formed to shape and welded.

In the past 15 years many attempts have been made to improve the corrosion resistance of zinc coatings through alloying of the zinc, for example as disclosed in Japanese Examined Patent (Kokoku) number 50-29821. Electrodeposited Zn—Ni alloy has been widely used to protect steel sheet products, with an improvement in corrosion resistance compared to Zn coatings. Typically, over 12 wt % of nickel is incorporated to provide an improved coating. Other attempts at corrosion resistance improvement include the dispersion of inorganic substances in the zinc, for example as disclosed in EP 0 174 019.

It is an object of the present invention to provide a zinc-based pre-treatment coating for a steel substrate, which has improved corrosion resistance. A further object is to provide a zinc-based pre-treatment coating which is suitable for electrocoating without the need for a phosphate or chromate treatment.

SUMMARY OF THE INVENTION

According to one aspect of the present invention there is provided a steel article at least a part of a surface of which is plated with a pre-treatment coating layer comprising at least 90% zinc, plus cobalt, at least one trivalent or higher-valent metal, and at least one colloidal inorganic material.

All percentages are given by weight unless otherwise specified.

In a preferred embodiment, the coating comprises:

92 to 99% zinc;

0.5 to 5% cobalt;

0.05 to 1.5% of at least one trivalent or higher-valent metal; and 0.4 to 5% of at least one colloidal inorganic material.

The steel article may be steel strip suitable for use in manufacturing motor vehicle bodies.

It is preferred that the higher-valent metal is chromium or molybdenum. Suitable colloidal inorganic materials include silica, alumina, and ferric oxide. A preferred colloidal inorganic material is silica, notably silica having a particle size range of 5 to 30 nm, preferably 10 to 20 nm. For convenience hereinafter, the invention will be described with reference to preferred embodiments in which the colloidal inorganic material is silica, but it is to be understood that the invention is not limited to these embodiments.

In a preferred embodiment, the coating comprises:

92 to 99% zinc;

0.5 to 5% cobalt;

0.05 to 0.5% chromium; and 0.4 to 5% silica.

In a particularly preferred embodiment, the coating comprises:

93 to 97.9% zinc;

1 to 5% cobalt;

0.1 to 0.2% chromium; and 1 to 3% silica.

Another aspect of the invention provides a steel article at least a part of a surface of which is plated with a corrosion-resistant coating layer consisting essentially of zinc, plus cobalt, chromium, and at least one colloidal inorganic material.

We have surprisingly also found that suitably coated steel substrates can accept paint without the need for pretreatment by phosphates or chromates, allowing painted steel strip to be produced with fewer production steps and reduced cost.

Without in any way limiting the present invention, the following theory is postulated as a possible mechanism for the improved properties obtained by the coatings. We have found that zinc crystal nucleation and growth occurs in a manner that results in each zinc crystal (about 50 nm thick) being encased in a 4 nm thick zinc oxide film. When zinc is co-deposited with cobalt, the deposits exhibit differential distribution of the other elements where the major portion associates with the oxide layer. Here nickel is believed to be acting as a barrier layer which protects each zinc crystal.

The present invention makes use of the fact that zinc oxide is an n-type semiconductor. Zinc atoms in the oxide may be displaced by tri and higher valency ions, for example chromium. This will limit oxide growth and thus enhance its protection of the underlying zinc metal. To enhance the thickness and stability of the nanoscale-thick oxide, one or more colloids are incorporated, for example colloidal silica. We believe that the oxide layer forms from a colloid of zinc oxide as the pH of the plating bath becomes less acid. The additional colloid is present with the ZnO colloidal suspension in the near cathode regions and becomes occluded in the deposit.

The introduction of tri or higher valency elements in the coating is not a simple step as there are limits to the solubility of such elements in the bath. The introduction of silica and the presence of certain levels of divalent cobalt appear to enhance the occlusion of the trivalent element to be absorbed into the zinc oxide or the zinc metal-oxide interface. This means that both the silica, the divalent metal (Co) and the higher-valent metal are not evenly dispersed in the coating; they exist as concentrated layers (about 3 to 10 nm thick) surrounding each zinc crystal. These additions modify the size and shape of the zinc crystals. It is believed that this helps to produce a surface profile into which the paint layer can interlock and form an effective bond.

To form the coating, the steel article is electroplated in an aqueous solution of the appropriate metal ions, containing a dispersion of the colloidal inorganic material.

Accordingly, a further aspect of the invention provides a process for applying a corrosion-resistant coating comprising at least 90% zinc to a steel substrate, the process comprising electroplating the steel substrate in an acidic solution containing:

zinc ions having a concentration in the range 0.2 to 2.5 mol/l;

divalent cobalt ions having a concentration in the range 0.10 to 1.0 mol/l;

ions of one or more trivalent or higher-valent metals having a total concentration in the range 0.004 to 0.05 mol/l; and a dispersion of a colloidal inorganic material having a concentration in the range 0.02 to 0.2 mol/l.

It is particularly preferred that the plating solution has components in the following concentration ranges:

zinc, 0.5 to 0.8 mol/l;

cobalt, 0.1 to 0.3 mol/l;

trivalent and/or higher valent metal, 0.01 to 0.03 mol/l;

colloidal inorganic material, 0.05 to 0.1 mol/l.

The process may be carried out as a continuous process on, for example, strip steel, or as a batch process.

BRIEF DESCRIPTION OF THE DRAWINGS

The invention will now be further described, by way of example, with reference to the following experimental results, and the accompanying drawing in which.

DETAILED DESCRIPTION OF THE EXAMPLES

EXAMPLE 1

A plating solution having the composition set forth in Table 1 was prepared:

TABLE 1

| Component | Weight/ litre | mol/litre |
|---|---|---|
| $ZnSO_4.7H_2O$ | 165 g | 0.57 |
| $CoSO_4.7H_2O$ | 56 g | 0.20 |
| $Cr_2(SO_4)_3.xH_2O$ | 4 g | 0.02* |
| $Na(CH_3COO).3H_2O$ | 14 g | |
| $Na_2SO_4$ | 142 g | |
| silica** | 5 g | 0.08 |

*concentration of chromium ion
**colloidal silica (10 to 20 nm size) from Brent Europe Ltd.

Bake hardening steel panels approximately 10×10 mm in size were plated using the solution in Table 1, in a static plating bath. Operating conditions were:

temperature: 50 to 60° C.;

Current density: 120 mA/cm$^2$; pH 2.

Plating was carried out for 90 seconds, to produce a 5 $\mu$m coating.

EXAMPLE 2

A plating solution having the composition set forth in Table 2 was prepared:

TABLE 2

| Component | Weight/ litre | mol/litre |
|---|---|---|
| $ZnSO_4.7H_2O$ | 550 g | 1.9 |
| $CoSO_4.7H_2O$ | 120 g | 0.44 |
| $(NH_4)_2SO_4$ | 50 g | 0.2 |
| $(NH_4)_6Mo_7O_{24}.4H_2O$ | 0.75 g | 0.004* |
| Silica** | 5 g | 0.08 |

*concentration of Mo ion;
**colloidal silica (10 to 20 nm in size) from Brent Europe Ltd.

Bake hardening steel panels of 10×10 mm in size were plated using the solution in Table 2, in a static plating bath. Operating conditions were:

Temperature: –50° C.;

Current Density: 100 mA/cm$^2$; pH: 1.5

Plating was carried out for 90 and 130 seconds, to produce 5 $\mu$m and 7 $\mu$m coatings respectively.

TEM analysis of the structure of these coatings revealed a nanostructure pattern in which Zn crystallites form hexagonal platelets of 100 to 200 nm diameter. The platelets are encapsulated by a thin ZnO layer (up to 10 nm thick), where the Mo and Co and silica are enriched. The detailed technique for TEM analysis of microstructure is described in a paper by H. Yan, J. Downes, P. J. Boden & S. J. Harris, *Philosophical Magazine A,* Vol. 70 No. 2, 373–389 (1994).

Figure 1:
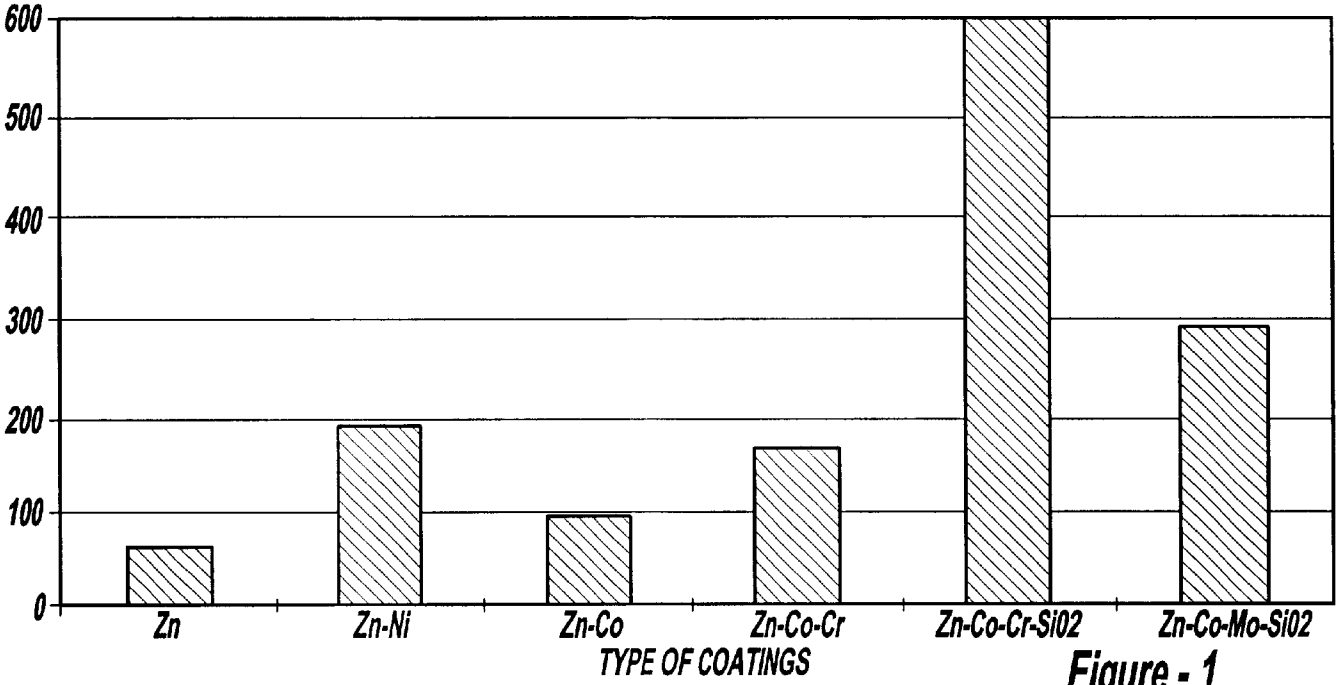
FIG. 1 is a graph showing comparative corrosion performances of various coatings.

The resultant coated panels from Examples 1 and 2 were tested using the Salt Spray method (ASTM B117 specification). Comparative results with other coatings prepared in a similar manner are given in Table 3, and shown graphically in FIG. 1. All of the coatings in FIG. 1 are 5 $\mu$m thick.

TABLE 3

Comparative Corrosion Performance

| Type of Coating | Time to 5% red rust (hrs) |
|---|---|
| Zn | 62 |
| Zn—Ni (Ni:13%) | 192 |
| Zn—Co (Co:1.5%) | 96 |
| Zn—Co—Cr (Co:1.5%; Cr:0.1%) | 168 |
| Zn—Co—Cr—$SiO_2$ (Co:2.6%;Cr:0.2%;$SiO_2$:1.9%) | 600 |
| Zn—Co—Mo—$SiO_2$ (Co:2.0%;Mo:0.5%;$SiO_2$:2.0%) | 288 |

Both of the coatings in accordance with the invention show improved corrosion performance compared to conventional coatings. The time to corrosion of 600 hours for the 10×10 mm panel with Zn—Co—Cr—$SiO_2$ is extremely, and surprisingly, high. This value is a mean value from several plated panels, the spread of results varying from 540 to 656 hours. Carrying out the same test on a panel of 100×50 mm size, coated with Zn—Co—Cr—$SiO_2$ (Co:2.4%; Cr:0.2%; $SiO_2$:1.9%) gave a time to corrosion result of 240 hours (spread 220 to 248 hours), which is lower, but still significantly better than the comparative known coatings.

The Zn—Co—Mo—$SiO_2$ coated panel with a coating thickness of 7 $\mu$m had a time to 5% red rust of 504 hours.

Adhesion to Electropaint Layer

Four steel panels (approximately 50×150 mm) were plated with a coating in accordance with the invention. The coating thickness was measured using a Fischer Permascope Model M10, and determined to vary between 9 and 12 microns across the four panels. The coating on each panel had the following approximate % composition:

| | |
|---|---|
| Zn: | 96.7 |
| Co: | 1.1 |
| Cr: | 0.2 |
| $SiO_2$ | 2.0 |

Two of the panels were given a standard phosphate treatment prior to electrocoating, and the other two panels were untreated prior to electrocoating, so that the paint was applied directly to the coating layer.

A cathodic electrocoat bath was made up using a commercial coating formulation comprising an epoxy resin and a lead silicate anti-corrosion pigment paste. This was used to electrodeposit a paint coating on the coated panels.

The panel depositions used, and the results obtained, are given below.

All panels were cured for 15 minutes at effective metal temperature (EMT) of 175° C.

Panels without Phosphate Pre-treatment a) 100 ohms series resistance. Wind up to 260 V with an initial current of 0.43 A (max). Bath temperature 29.5° C.; total deposition time 135 s. Current passed: 10.6 coulombs. Precoating film thickness: 12 μm. This produced a smooth looking film with an average film build of 24 μm. No pinholing defects were noted.

b) 100 ohms series resistance. Wind up to 260 V with an initial current of 0.42 A (max). Bath temperature of 29.5° C.; total deposition time 135 seconds. Current passed: 9.7 coulombs. Precoating film thickness: 9 μm. This produced a smooth looking film with an average film build of 24 μm. No pinholing defects were noted.

Panels with Phosphate Pre-treatment c) 100 ohms series resistance. Wind up to 280 V with an initial current of 0.36 A (max). Bath temperature of 29.5° C.; total deposition time 135 seconds. Current passed: 10.0 coulombs. Precoating film thickness: 12 μm. This produced a smooth looking film with an average film build of 22 ρm. A small area of moderate to bad pinholing was noted along one edge of the panel. Pinhole defects at 280 V are not uncommon, and defects similar to this are usually seen when depositing electrocoat over Galvannealed precoated steels.

d) 100 ohms series resistance. Wind up to 260 V with an initial current of 0.33 A (max). Bath temperature of 31.5° C.; total deposition time 135 seconds. Current passed: 10.4 coulombs. Precoating film thickness: 11 μm. This produced a smooth looking film with an average film build of 24 μm. No pinholing defects were noted.

Film Adhesion

Figure 2:
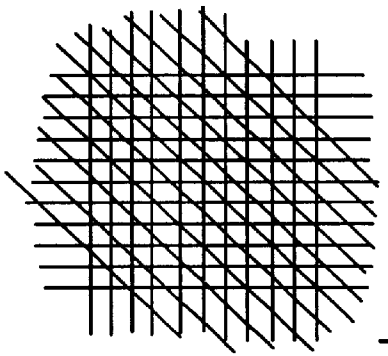
FIG. 2 shows the arrangement of scribe cuts used in testing for electrocoat film adhesion.

Each panel was tested for film adhesion of the deposited electrocoat film using Ford Laboratory Test Method B1 106-01 Method B (Paint Adhesion Test). Each film was subjected to a three way scribe cut (using a carbide tipped scriber) at right angles and diagonally in one direction, as shown in FIG. 2. The parallel scribed lines are 3 mm apart. To the scribed area was applied 3M No. 898 adhesive tape, with firm pressure. Within 90 +/−30 seconds of application, the tape was pulled off rapidly (not jerked) back upon itself at as close an angle of 180° to the panel surface as possible.

All four panels produced very good results. All had excellent adhesion with no removal of any paint.

Further 5 μm coatings were plated using the formulation given in Table 1, under different temperatures and currents. The variables and the resulting coating compositions are given in Table 3 below.

TABLE 4

| Plating Variables | | Composition (%) Zn | Co | Cr | $SiO_2$ |
|---|---|---|---|---|---|
| at 120 | 45° C. | 97.3 | 1.4 | 0.2 | 1.1 |
| mA/cm² | 50° C. | 95.6 | 2.4 | 0.2 | 1.8 |
| 5 μm | 60° C. | 94.2 | 4.2 | 0.1 | 1.5 |
| at 50° C. | 90 mA/cm² | 96.6 | 1.7 | 0.1 | 1.6 |
| 5 μm | 120 mA/cm² | 95.6 | 2.4 | 0.2 | 1.8 |
| | 150 mA/cm² | 96.3 | 1.7 | 0.1 | 1.9 |

By varying the temperature at which plating is carried out, it was found possible to vary the proportions of each component in the coating. The concentration of cobalt was particularly temperature sensitive, increasing with increasing temperature. All of these coatings showed improved corrosion resistance compared to conventional coatings.

Further corrosion test results are given below in Table 5, for selected coatings from Table 4, and for other coatings obtained using double the concentrations of zinc and cobalt in the coating solution given in Table 1.

TABLE 5

Corrosion Test Results (ASTM B117)

| Sample | Substrate size/mm | Current Density used 90 mA/cm² | 120 mA/cm² | 200 mA/cm² | 300 mA/cm² |
|---|---|---|---|---|---|
| (A) | 10 × 10 | 450 | 600 | | |
| | 100 × 50 | 218 | 240 | | |
| (B) | 100 × 50 | | 92 | 140 | 211 |

(A) = coating solution of Table 1

(B) = as coating solution of Table 1, but double concentration of zinc sulphate and cobalt sulphate.

All values are for static plating. A person skilled in the art will readily be able to determine suitable plating conditions for use in a continuous plating process.

Figure 3:
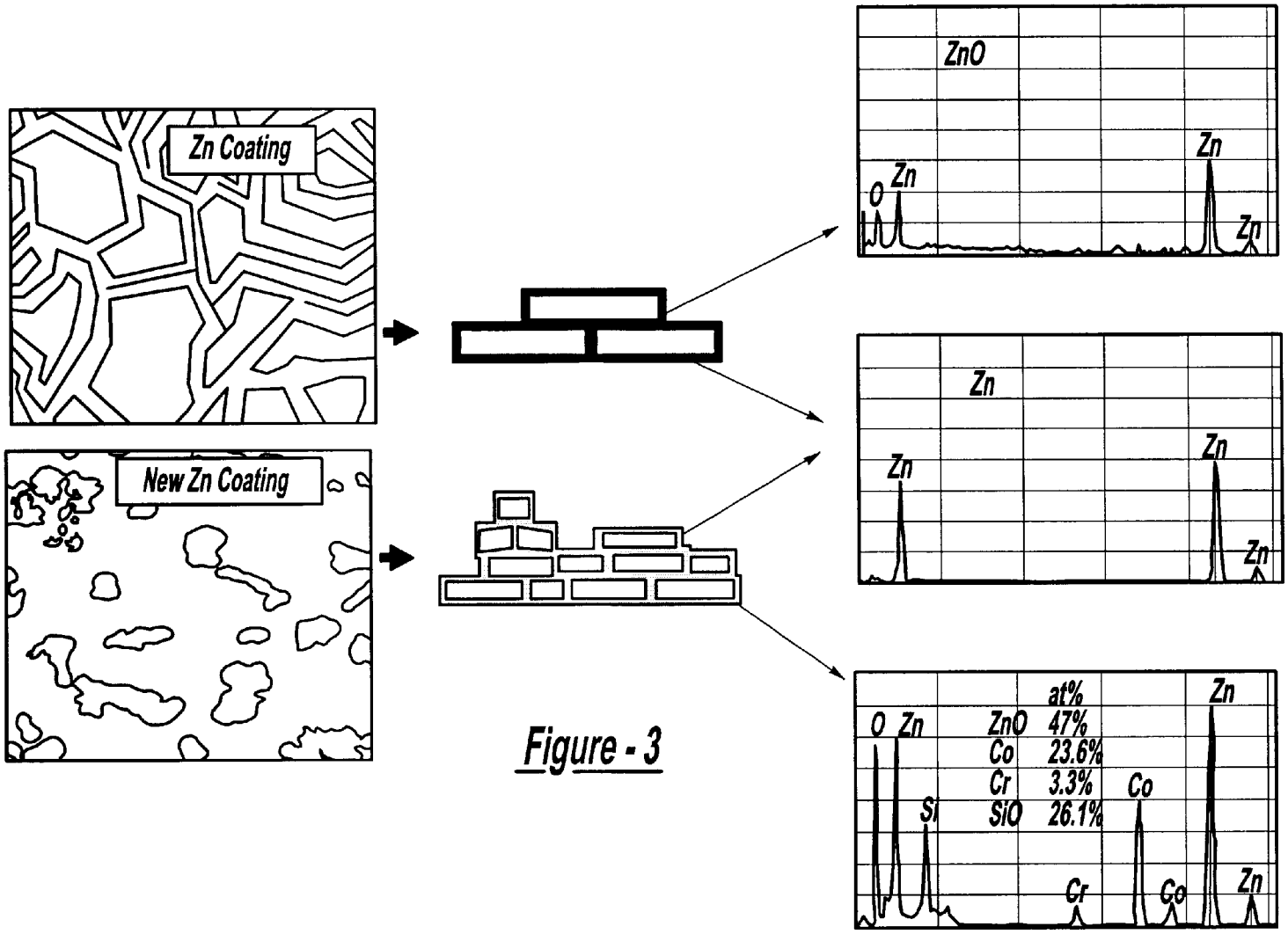
FIG. 3 shows SEM pictures and schematic surface profile drawings of conventional zinc and zinc alloy coatings, and of a coating in accordance with one aspect of the present invention.

Referring now to FIG. 3, the pictures on the left hand side are SEM microstructures of conventional zinc coatings (top) and the Zn—Co—Cr—$SiO_2$ coating from Table 3 ("New Zn Coating"). The pictures in the middle are schematic microstructures from TEM examination of the coatings, and the graphs on the right hand side show EDX analysis results from the TEM examinations. The conventional zinc coating has a laminated structure consisting of Zn and ZnO. The new coating shows a similar structure but with finer Zn crystals and the enrichment of Co, Cr and $SiO_2$ additions along the ZnO layers. It is surmised that this confers on the new coating the property of superior corrosion resistance which is observed.

Based on TEM analysis, the new coatings have a microstructure in which Zn crystallites form hexagonal platelets of diameter 20 to 200 nm and thickness of 20 to 50 nm. They are encapsulated by a thin ZnO layer of 2 to 20 nm thickness, in which the components other than Zn are enriched. The surface morphology of the coatings shows surface roughness which is apparently caused by stacks of platelets forming peaks or promontories as discussed below.

Figure 4:
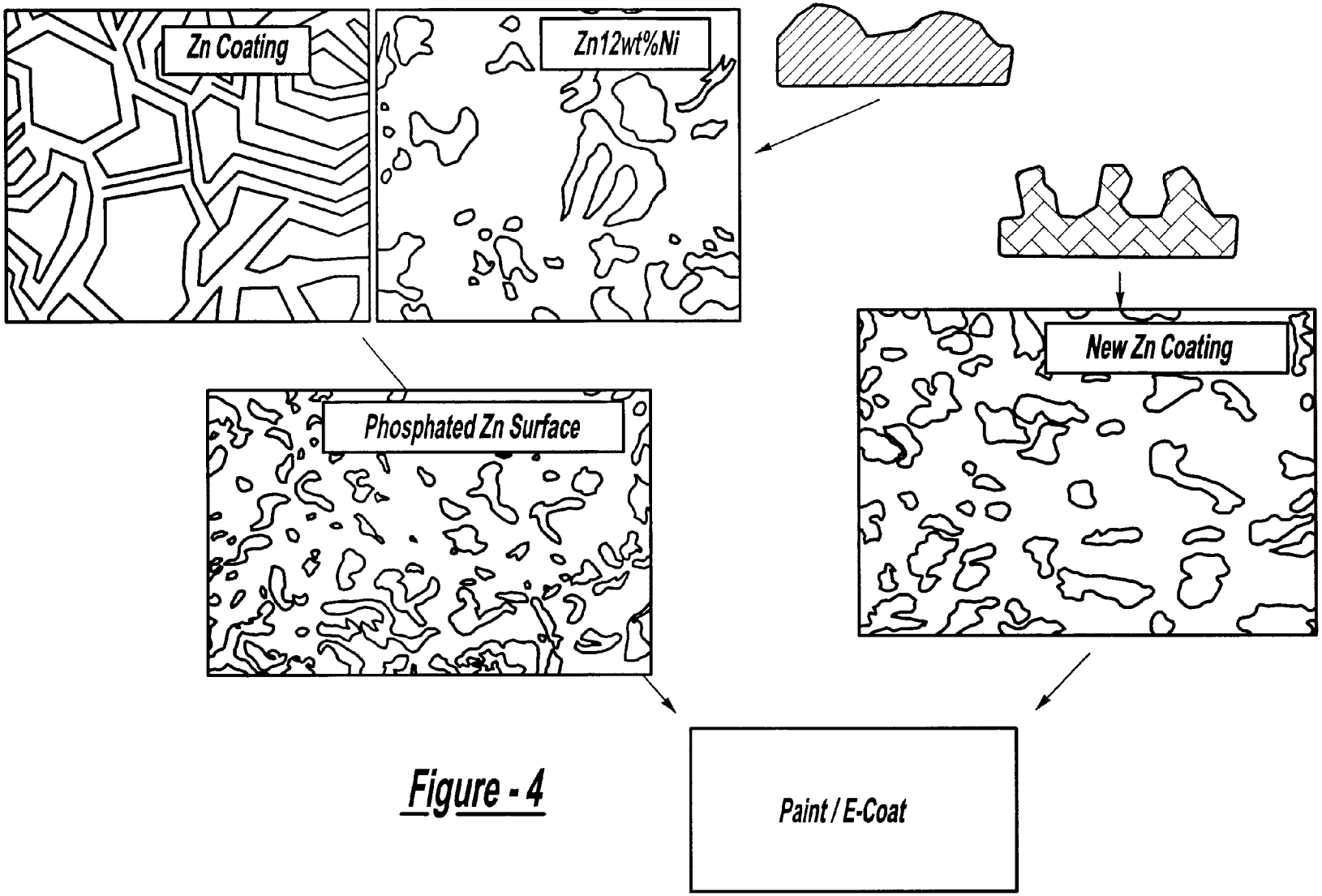
FIG. 4 shows SEM analysis results for a conventional zinc coating and for a coating in accordance with the present invention.

FIG. 4 shows SEM micrographs of surface structures of conventional Zn and Zn alloy coatings with and without phosphating (left hand side), and of the new Zn—Co—Cr—$SiO_2$ coating from Table 3. Conventional Zn and Zn alloys require phosphating or similar surface treatment to enable them to receive a sufficiently coherent paint layer. The new coatings can bond directly to paint, and it is believed that this property is due to the micro-rough surface profile (represented at the top right of FIG. 4) which has peaks or promontories to which the paint can key.

Figure 5:
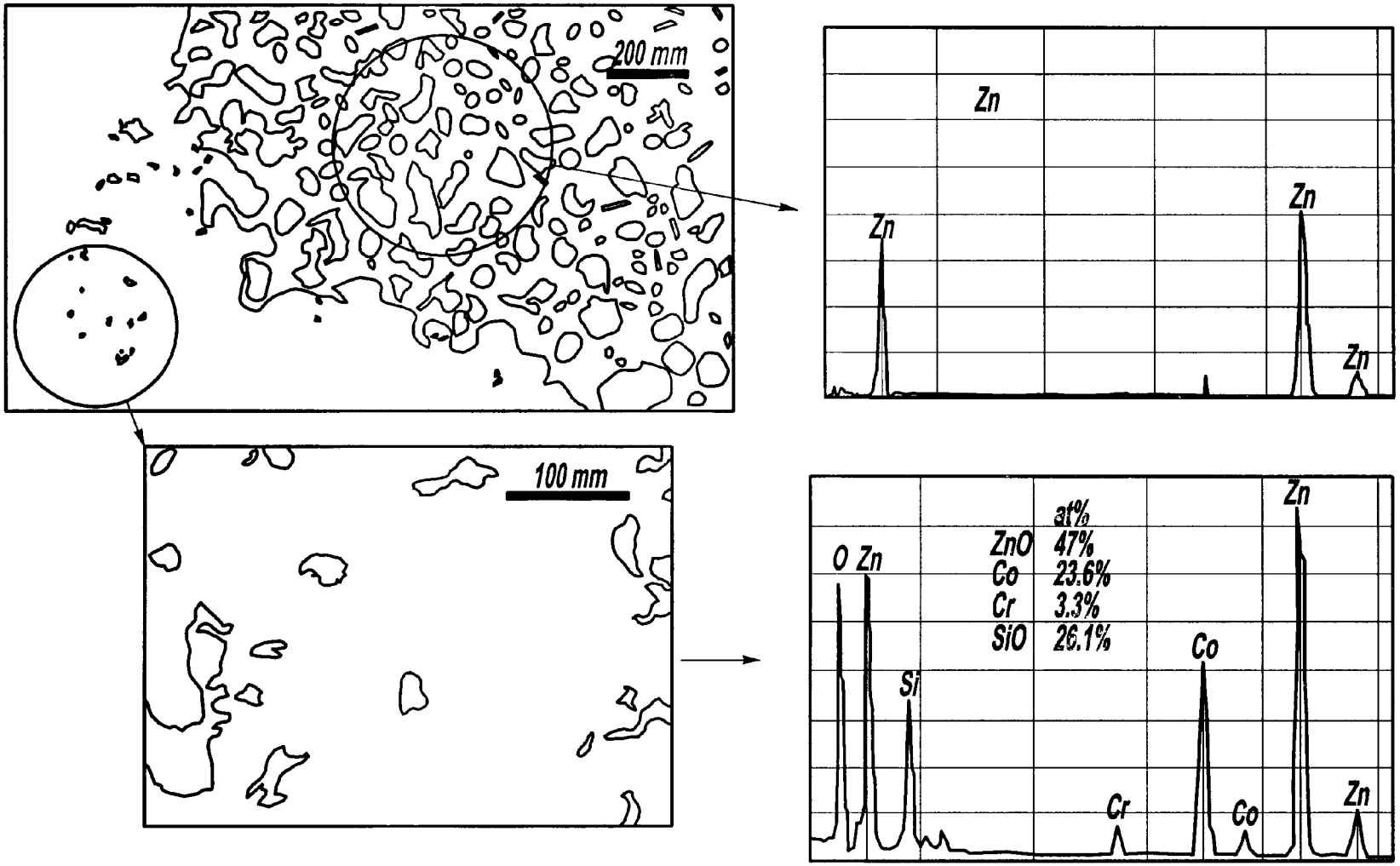
FIG. 5 shows the breakaway of crystallites from a coating in accordance with the invention under the exposure of a TEM electron beam, and EDX spectra corresponding to the crystallites and the remaining region.

Further evidence for the microstructure of the new coatings in accordance with the invention is given in FIG. 5. The top left TEM picture shows the breakaway of Zn crystallites from a Zn-2.4Co-0.1Cr-2.1$SiO_2$ coating under exposure of a TEM beam due to a thermal fracture along the Zn/ZnO laminae. The bottom left TEM picture shows the remaining region after the breakaway of the Zn crystallites. The corresponding EDX spectra shows the enrichment of Co, Cr, Si together with the ZnO in the remaining region.

What is claimed is:

1. A steel article comprising:

a steel surface, at least a portion, having a corrosion-resistant coating of at least 90% zinc, cobalt, at least one trivalent or higher valent metal, and at least one colloidal inorganic material; and an electrodeposited paint layer directly on said corrosion-resistant coating.

2. The steel article of claim 1, wherein the coating comprises:

92 to 99% zinc;

0.5 to 5% cobalt;

0.05 to 1.5% of at least one trivalent or higher-valent metal; and 0.4 to 5% of at least one colloidal inorganic material.

3. The steel article of claim 1, wherein the higher-valent metal is chromium or molybdenum.

4. The steel article of claim 1, wherein the colloidal inorganic material is silica having a particle size range of 10 to 20 nm.

5. The steel article of claim 1, wherein the coating comprises:

92 to 99% zinc;

0.5 to 5% cobalt;

0.05 to 1.5% chromium; and 1 to 3% silica.

6. The steel article of claim 1, wherein the coating comprises:

93 to 97.9% zinc;

1 to 5% cobalt;

0.1 to 0.2% chromium; and 1 to 3% silica.

7. A method of producing a painted steel article, comprising the steps of:

plating at least a portion of a steel surface with a corrosion-resistant coating of at least 90% zinc, cobalt, at least one trivalent or higher-valent metal and at least one colloidal inorganic material; and electrodepositing a paint layer directly on said coating.

8. The method of claim 7 wherein said paint layer interlocks and bonds with said coating layer.

9. The method of claim 7, wherein, the coating comprises:

92 to 99% zinc;

0.5 to 5% cobalt;

0.05 to 1.5% of at least one trivalent or higher-valent metal; and 0.4 to 5 % of at least one colloidal inorganic material.

10. The method of claim 7, wherein the higher-valent metal is chromium or molybdenum.

11. The method of claim 7, wherein the colloidal inorganic material is silica having a particle size range of 10 to 20 nm.

12. The method of claim 7, wherein the coating comprises:

92 to 99% zinc;

0.5 to 5% cobalt;

0.05 to 1.5% chromium; and 0.4 to 0.5% silica.

13. The method of claim 7, wherein the coating comprises:

93 to 97.9% zinc;

1 to 5% cobalt;

1.1 to 0.2% chromium; and 1 to 3% silica.

14. The method of claim 7, wherein the said corrosion-resistant coating is applied by electroplating the steel article in an acidic solution containing:

zinc ions having a concentration in the range 0.5 to 2.5 mol/l;

divalent ions of cobalt having a total concentration in the range 0.1 to 1.0 mol/l; and a dispersion of a colloidal inorganic material having a concentration in the range 0.02 to 0.2 mol/l.

15. The method of claim 14, wherein the plating solution has components in the following concentration ranges:

zinc ions, 0.5 to 1.2 mol/l;

cobalt ions, 0.1 to 0.4 mol/l;

trivalent and/or higher valent metal ions, 0.01 to 0.03 mol/l;

colloidal inorganic material, 0.05 to 0.1 mol/l.

16. The method of 14, wherein the higher-valent metal is chromium or molybdenum.

17. The method of claim 14, wherein the colloidal inorganic material is silica having a particle size range of 10 to 20 nm.

18. The method of claim 14, wherein the article is strip steel.

* * * * *